US005480313A

United States Patent [19]

d'Alayer de Costemore d'Arc

[11] Patent Number: 5,480,313

[45] Date of Patent: Jan. 2, 1996

[54] AUTOMATIC DISCONNECT MECHANISM FOR ELECTRICAL TERMINAL FITTINGS

[75] Inventor: Stephane M. A. d'Alayer de Costemore d'Arc, Genappe, Belgium

[73] Assignee: Staar S.A., Brussels, Belgium

[21] Appl. No.: 238,668

[22] Filed: May 5, 1994

Related U.S. Application Data

[63] Continuation-in-part of Ser. No. 109,535, Aug. 20, 1993, abandoned.

[30] Foreign Application Priority Data

Sep. 2, 1992 [BE] Belgium ..... 92 00777

[51] Int. Cl.[6] ..... H01R 13/62

[52] U.S. Cl. ..... 439/159; 439/352; 439/180

[58] Field of Search ..... 439/152–160, 439/372, 351, 352, 353, 357, 180

[56] References Cited

U.S. PATENT DOCUMENTS

| | | | |
|---|---|---|---|
| 2,853,690 | 9/1958 | Madison | 439/258 |
| 4,042,292 | 8/1977 | Chensky | 339/45 R |
| 4,045,106 | 8/1977 | Borg | 439/152 |
| 4,421,373 | 12/1983 | Ratchford et al. | 439/152 |
| 4,548,455 | 10/1985 | Ezure | 439/152 |
| 4,717,351 | 6/1988 | McCormick | 439/153 |
| 4,907,981 | 3/1990 | Gallusser et al. | 439/258 |
| 5,171,291 | 12/1992 | d'Alayer et al. | 439/152 |
| 5,266,040 | 11/1993 | Merrill et al. | 439/159 |

FOREIGN PATENT DOCUMENTS

| | | | |
|---|---|---|---|
| 0487037 | 6/1929 | Australia | 439/180 |
| 1164127 | 5/1958 | France | 439/180 |
| 1138364 | 1/1969 | United Kingdom . | |
| 9220123 | 11/1992 | WIPO . | |

OTHER PUBLICATIONS

Maréchal brochure, "Self–Ejecting Decontactors", published in France prior to Sep. 1992.

*Primary Examiner*—David L. Pirlot
*Attorney, Agent, or Firm*—Leydig, Voit & Mayer

[57] ABSTRACT

An electrical fitting to be connected to an end of a cable, including an automatic disconnect mechanism which separates the electrical fitting from a mating electrical fitting responsive to a pull on the cable, the electrical fitting comprising at least one thrust member mounted for axial movement in ejection and retraction strokes between retracted and projecting positions and a trigger system which causes a pull on the cable of greater than a predetermined force to release the thrust members from the retracted position, the thrust members being moved axially in the ejection stroke to the projecting position by a resilient member after release to engage a fixed element associated with a mating fitting and cause the casing and the electrical contact elements therein to be moved by reaction and separated from contact elements of the mating fitting.

17 Claims, 7 Drawing Sheets

AUTOMATIC DISCONNECT MECHANISM FOR ELECTRICAL TERMINAL FITTINGS

This is a continuation-in-part of application Ser. No. 08/109,535 filed Aug. 20, 1993 now abandoned.

The present invention relates to electrical fittings and more particularly concerns a device for automatically disconnecting or uncoupling mating terminal fittings used to interconnect an electrical cord to a power outlet responsive to force applied to the cord and through the cord to one of the mating fittings.

BACKGROUND OF THE INVENTION

An electrical plug connected to an appliance is very often subjected to considerable forces, especially through the connecting lead cord or cable, when the user wishes to disconnect it from its socket. Indeed, present-day standards covering both plugs and sockets in practically all countries impose a minimum separation force for the withdrawal of a plug from its socket. All too often the user applies a greater separation force and, for reasons of convenience, applies this to the cord rather than to the plug, resulting in stretched, damaged or even broken conductors, creating a high risk of short-circuit and/or of electrocution. In other cases, particularly in the case of portable and/or mobile appliances, the user often tries to move as far away as possible by pulling on the cord rather than by plugging into a nearer socket, or may try to "remotely" disconnect the appliance by pulling on the cord; both of these practices present the same disadvantages and hazards as those stated above.

In addition, it is found that repeated removal of plugs from an electric socket weakens the mounting of the socket, again producing the same disadvantages and hazards.

Applicant's U.S. Pat. No. 5,171,291 describes a mechanical device facilitating the removal of an electrical plug from its socket by utilizing a thrust member fitted between the plug and the socket which is actuated by a control element mounted on the plug or on the socket and affords a suitable mechanical advantage to reduce the force required. However, while this device does greatly reduce the risks of short-circuit and/or electrocution, it requires the presence of the user close to the plugsocket connection in order to be actuated.

U.S. Pat. No. 4,045,106 describes an automatic disconnect system for an electrical plug which is remotely actuated by a pull on the power cable connected to the plug but requires the user to exert a force at least equal to the minimum separation force between the plug and a socket to activate the system. Moreover the system requires the power cable to pass through a sleeve forming a suitable angle with the plug support, which complicates its construction yet is operative only if the cable is moved laterally. Furthermore, the system increases very considerably the dimensions of the standard plug to which it is connected, since the plug slides inside a casing. In addition, the spring performing the disconnecting movement hampers the actuation of this movement so that a stable minimum limit for such actuation cannot be readily guaranteed, let alone adjusted to suit the manufacturer. Lastly, the conductors of the cable are bound to be weakened by their twisting movement in relation to their attachment.

SUMMARY OF THE INVENTION

The principal object of the present invention is to remedy the aforesaid disadvantages by providing a simple, effective and reliable mechanism for automatically disconnecting mating terminal fittings, i.e., plugs and sockets used to interconnect an electrical cord to a power outlet, when an element of one of the fittings is displaced or when the conductor cord or cable to which the one fitting (which may be a plug or a socket) is connected is pulled by a force of a given minimum amount.

Another object of the invention is to provide a disconnect mechanism which is actuated by the cord or cable even when the cord or cable extends at an angle relative to the axis of symmetry of the terminal fitting to which it is connected.

Another object of the invention is to provide a disconnect mechanism which is incorporated into a terminal without significantly increasing the dimensions of the fitting, and particularly its diameter.

Another object of the invention is to provide a disconnect mechanism which is simple to use and does not require an undue force to operate, so that it can easily be operated by any user particularly one who is not strong.

Another object of the invention is to provide a disconnect mechanism which has an actuation-force threshold that is relatively precise and easily adjustable.

Another object of the invention is to provide a disconnect mechanism which can be applied to a wide variety of plugs or sockets meeting existing standards.

Another object of the invention is to provide a plug or socket disconnect mechanism with an arrangement which prevents it from being inserted into a mating fitting if the disconnect mechanism is not in the operative position.

Another object of the invention is to provide a disconnect mechanism which has a small number of component parts thus facilitating mass production and ease of assembly.

Another object of the invention is to provide a disconnect mechanism which allows the cable conductors to be connected to the contacts in the usual manner for any standard fitting.

Another object of the invention is to provide a fitting with the disconnect mechanism which cannot be easily disassembled by the user to prevent accidents as required by regulations in some jurisdictions.

Another object of the invention is to provide a disconnect mechanism actuated by a pull exerted on the power cable.

BRIEF DESCRIPTION OF THE DRAWINGS

Other advantages and features will appear from the following description taken in conjunction with the drawings in which.

DETAILED DESCRIPTION OF THE PREFERRED EMBODIMENTS

Figure 1:
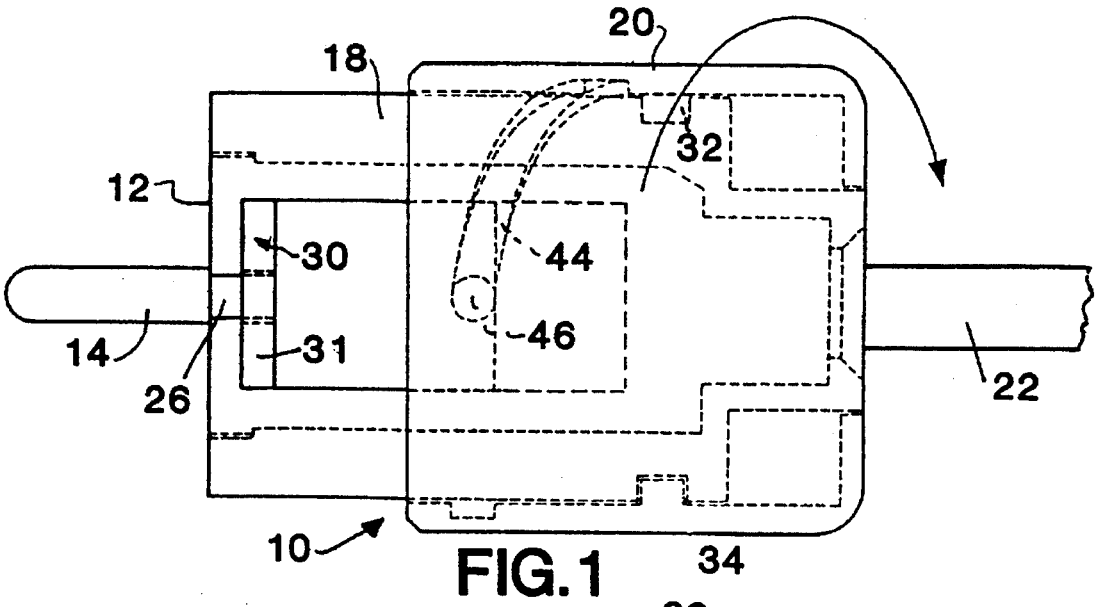
FIG. 1 is a side view of a disconnect mechanism applied to an electrical terminal fitting, herein shown as a plug, according to this invention with the disconnect mechanism in the released position.

To facilitate the description, and to avoid overburdening the drawings, only the elements essential for an understanding of the invention have been depicted in the drawings.

Shown in FIGS. 1–9 is an electrical terminal fitting and automatic disconnect mechanism constructed according to this invention, specifically an electrical plug 10, with disconnect mechanism, which plug and disconnect mechanism meet various standards at present in force in European countries. FIGS. 10–17 show electrical terminal fittings (either a plug or a socket) with disconnect mechanism according to this invention, which fittings and disconnect mechanism meet U.S. standards.

Embodiment of FIGS. 1–9

Referring first to FIGS. 1–9, as shown in FIG. 1, like any standard electrical plug, the plug 10 comprises a support member 12 for contact pins 14 adapted to be inserted in powered clips of a socket 16 (FIG. 3), and a casing 18. In addition, in accordance with the invention, a circular control member 20 is rotatably mounted to the casing 18 for the support member 12.

The support member 12, which is removable from the casing 18, carries the contact pins 14 (ground included) to which the conductors of a standard electric cable 22 are connected and is fixed to the casing 18 with a screw 24.

In the preferred embodiment illustrated, the casing 18 is substantially cylindrical in shape, and its forward peripheral surface located close to the support member 12 meets required standards so that the casing 18 is properly received within a standard socket 16; in particular, two guide rails 26 (see FIGS. 7–9) are provided which are received within guide slots (not shown) in the socket 16. At its other rearward end, the casing 18 allows the passage of the cable 22.

Figure 9:
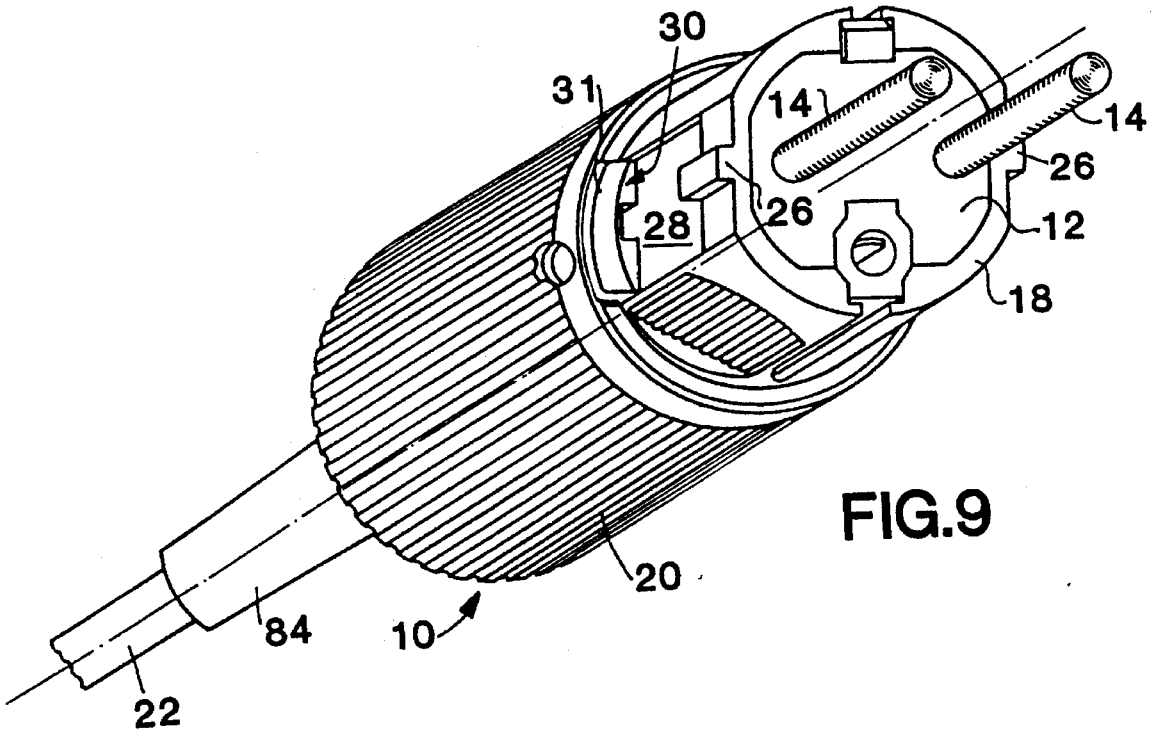
FIG. 9 is a perspective view of the electrical plug assembled with the elements of FIG. 8.

According to the invention, recesses 28 are provided in the peripheral surface of the casing 18 and axially movable thrust members 30 are supported in the recesses 28 preferably at diametrically opposite points of the casing 18 and are trapped within the control member 20. The length of axial travel of the thrust members 30 in the recesses 28 essentially corresponds to the length of the contact pins 14. The forward ends of the thrust members 30 have curved projecting shoulders 31 that conform to the front edge of the circular control member 20 and abut the front edge when in a retracted cocked position, as shown in FIG. 9.

Figure 4:
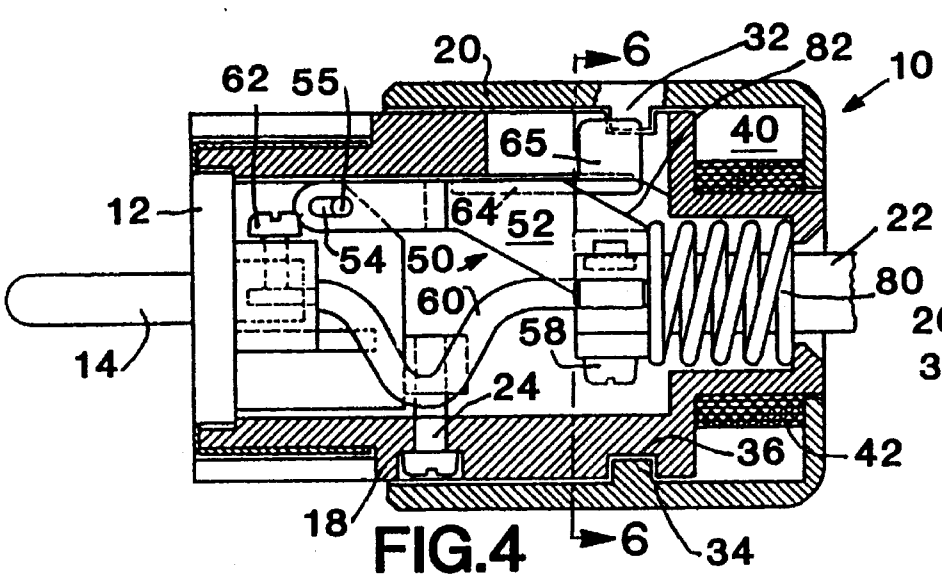
FIG. 4 is a partial sectional view in the section plane 4—4 of FIG. 7 with some elements of the electric plug shown in FIGS. 2 and 7, shown in section.
Figure 6:
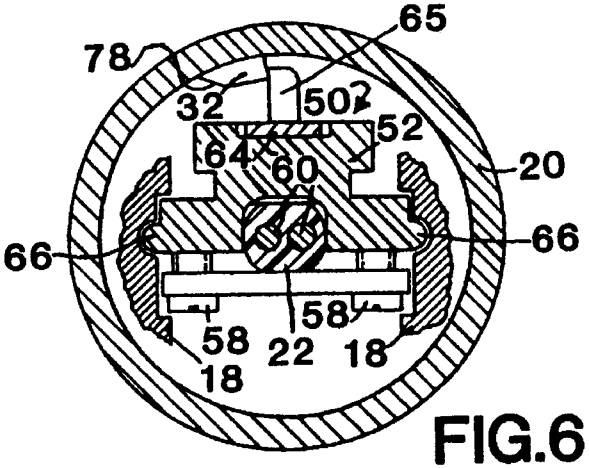
FIG. 6 is a sectional view in the section plane 6—6 of FIG. 4.

The control member 20 is mounted coaxially on the casing 18 and is guided in rotation by means of at least two studs 32, 34 cooperating with a groove 36 in the periphery of the casing 18. The stud 32 also is engaged by a catch to hold the control member 20 in the cocked position (FIGS. 4, 6).

Figure 8:
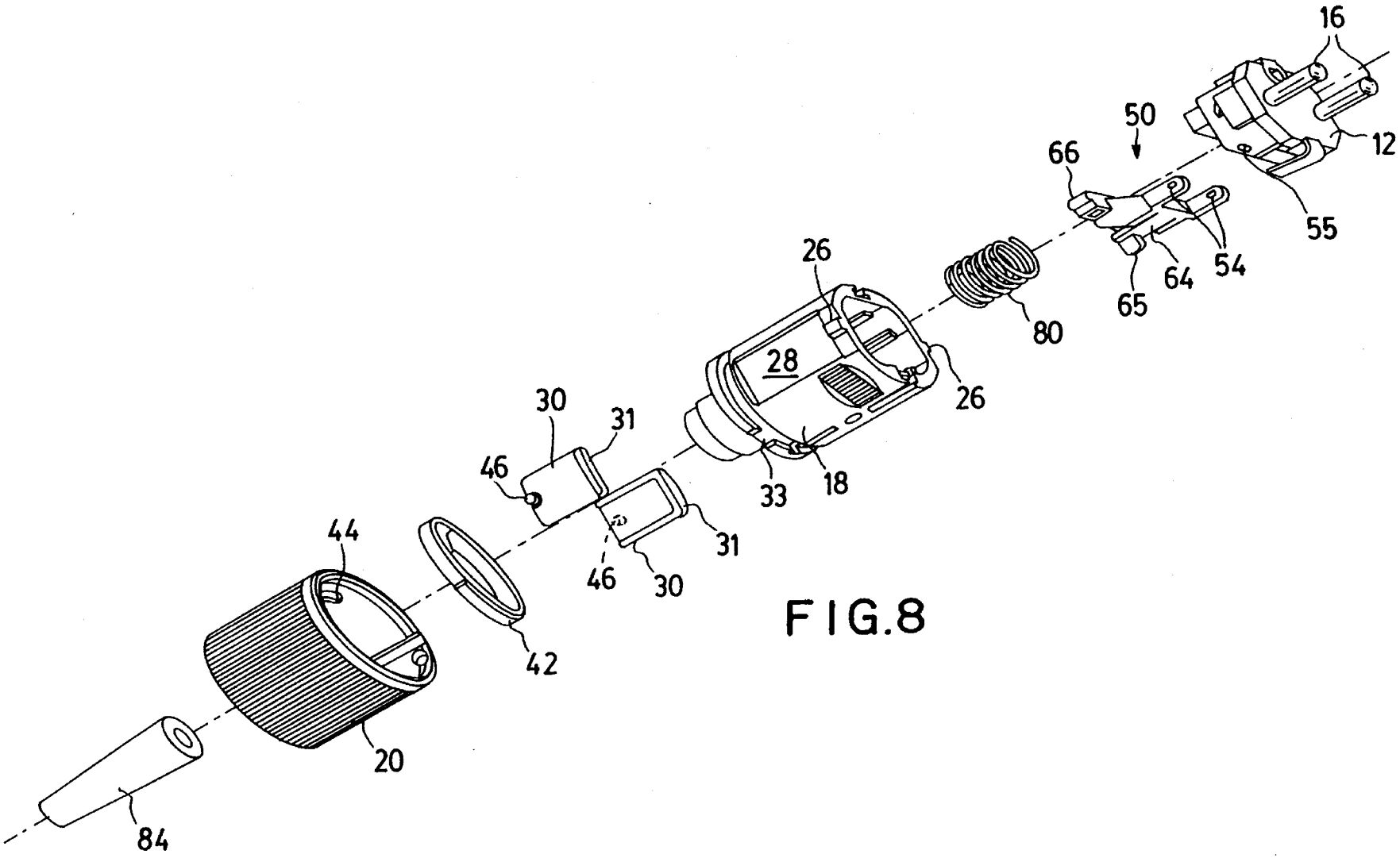
FIG. 8 is an exploded view of major elements of the electrical plug of FIGS. 1–7.

The studs 32, 34 are engaged in the groove 36 by means of longitudinal assembly slots 33 provided in the casing 18 as shown in FIG. 8.

The outer surface of the casing 18 and inner surface of the control member 20 are shaped to form a chamber 40 which houses resilient means, for example, a spiral spring 42, attached at its respective ends to the casing 18 and to the control member 20 so that one of these elements, for example the control member 20, is rotated by or against the action of these resilient means while the other, for example the casing 18, is fixed.

In carrying out the invention, cam means are provided for moving the thrust members 30 axially responsive to rotation of the control member 20; for this purpose the inner surface of the control member 20 has two helical grooves 44 (FIGS. 1, 2, 8) to trap a stud 46 carried by each thrust member 30 which cause the latter to move axially in the recess 28 upon rotation of the control member 20. As FIGS. 1 and 2 show, the length of the control member 20 is such that it overlaps a part of the thrust members 30 at all times, keeping them in their respective recesses 28.

It will now be seen that rotation of the control member 20 one way or the other about its axis of symmetry causes the thrust members 30 to move either forward towards the support member 12 or rearward in the opposite direction away from the support member 12.

Figure 2:
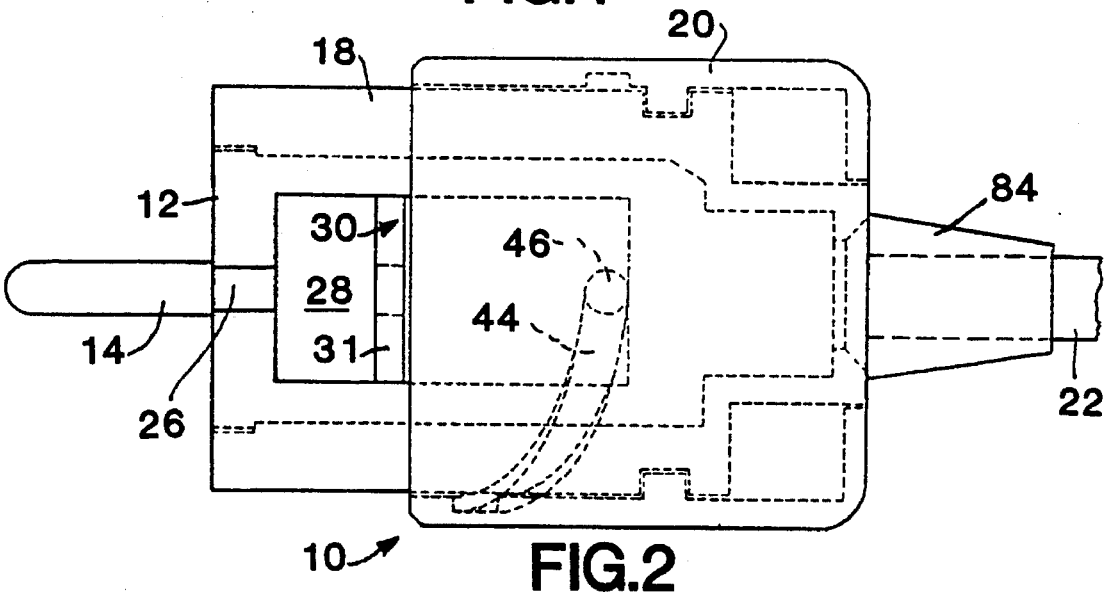
FIG. 2 is a view similar to FIG. 1, with the disconnect mechanism in the cocked position.
Figure 3:
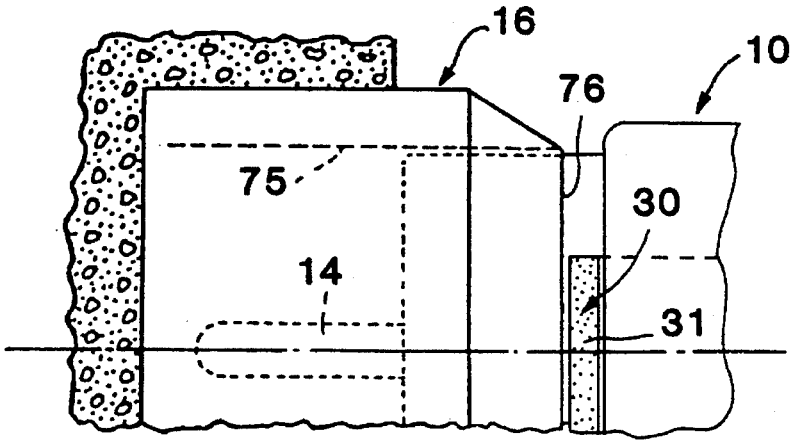
FIG. 3 is a fragmentary side view of an electric socket embedded in a wall shown in section, and also showing in fragmentary side view an electric plug with the disconnect mechanism cocked as shown in FIG. 2 and the plug fully inserted in the socket.
Figure 7:
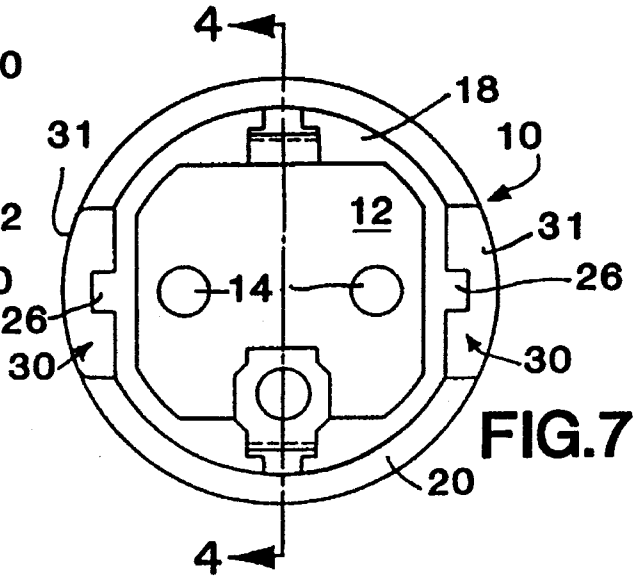
FIG. 7 is a front view of the electrical plug of FIG. 1.

Further in accordance with the invention, a trigger system 50 (shown in FIGS. 4–6, 8) is provided to hold the thrust members 30 in a retracted cocked position as shown in FIGS. 2, 3 and 9 the trigger system 50 in this case having a connection to the cable 22 and acting on the control member 20.

This trigger system 50 principally comprises a body 52 connected to the support member 12 by two slotted holes 54 which have studs 55 of the support member 12 passing through them, the holes 54 being elongated so that the body 52 is movable longitudinally. At its other end, the body 52 has a clamp provided with screws 58 for clamping to the cable 22.

AS FIGS. 4 and 6 show, the conductors 60 of the cable 22 form a slight loop to allow longitudinal movement of the body 52 inside the casing 18 without any force being applied to their connections (by means of a screw 62) to each contact pin 14. The arrangement of this trigger system 50 allows it to pivot about the studs 55 when the support member 12 is withdrawn from the casing 18 after unloosening of the securing screw 24, exposing the screws 62 and thus facilitating connection by the user of the conductors 60 to the contact pins 14. The body 52, which may be a molded metal or resin part, has a flexible lug 64 which carries a catch 65 (see FIG. 8); the body 52 also has two lateral guide surfaces 66 co-operating with profiles provided in the inner surface of the casing 18 for guiding the body 52 for movement longitudinally (see FIG. 6). All the major elements of the plug 10 except the contact pins 14 are preferably of molded resin for strength and insulating properties, but the manufacturer can choose the materials desired for these elements.

In the released position, the disconnect mechanism of the invention is located in the configuration depicted in FIG. 1. Preferably, the thrust members 30 and more particularly their shoulders 31 (see FIG. 3) prevent insertion of the plug 10 into the recess 75 of a standard socket 16, which is shown diagrammatically and partially in FIG. 3 since the shoulders 31, located outside the standard profile of the support member 12 and socket 16, abut against the outer peripheral surface 76 or face of the socket 16 before the contact pins 14 can penetrate into the body of the socket.

Rotation of the control member 20 with respect to the casing 18 in the counterclockwise direction (viewed from the support member 12 end) and against the resilient means 42 causes:

- rotation of the grooves 36 and hence a camming action exerted through the studs 46 which causes the thrust members 30 to move rearward towards the back of the plug 10;
- the helical grooves 44 may have a changing slope so that in the ejection stroke a large initial thrust force will be exerted by the members 30 to start the withdrawal movement of the pins 14, which then drops off to complete the withdrawal movement;
- rotation of the stud 32 inside the control member 20 which has a sloping surface 78 and which deflects the flexible lug 64 inwardly thus allowing the stud 32 to pass beneath and to the other side of the catch 65 (see FIG. 6) where it is held by the catch 65.

The disconnect mechanism, according to this invention, is then in the position shown in FIGS. 2, 3, 4 and 6, that is to say in the cocked position, with the catch 65 retaining the control member 20 against the action of the resilient means 42.

As the thrust members 30 have been retracted, the plug 10 can now be fully inserted into a socket 16 (see FIG. 3).

The electric plug 10 then stays in this inserted position in the socket 16 until the trigger system 50 is actuated to move the catch 65 inwardly and thereby release the control member 20 for rotation by the spiral spring 42, which causes the thrust members 30 to move forward in their ejection stroke. Forward movement of the thrust members 30 relative to the casing 18 causes the plug 10 to be ejected from the socket 16 by reaction.

According to this embodiment of the invention, the trigger system 50 is released by pulling on the cable 22. The threshold value of force for such a pull is determined, in particular, by the characteristics of a second resilient means, for example, a compression spring 80, positioned between the end of the casing 18 and the trigger system 50 and keeping the latter in the position shown in FIG. 4.

When a pull which exceeds this threshold value is exerted on the cable 22, the spring 80 is compressed and the flexible lug 64 is moved into engagement with a longitudinally inclined plane 82 formed in the casing 18. This engagement causes the lug 64 to pivot downward (FIG. 5) and inwardly towards the axis of the plug 10.

Figure 5:
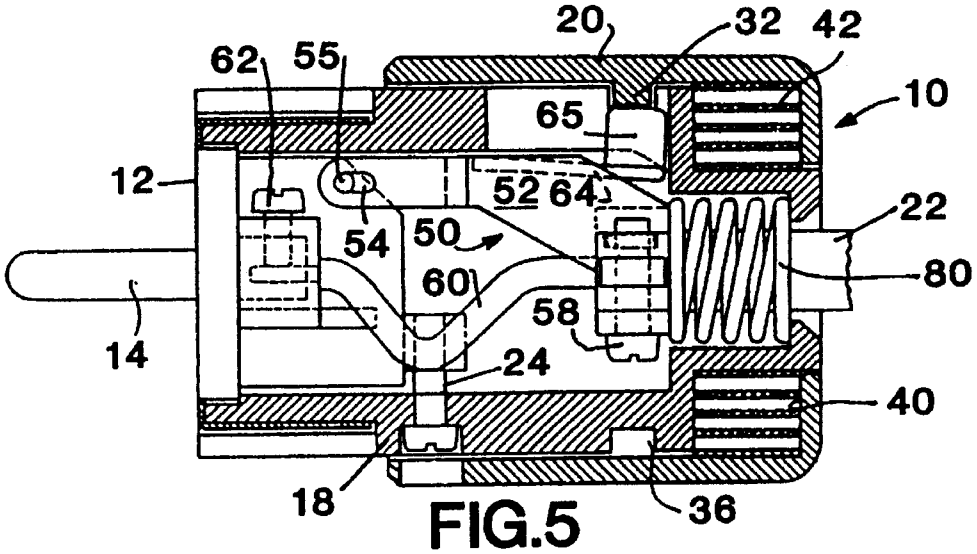
FIG. 5 is a view similar to FIG. 4, with the disconnect mechanism in the act of being released by pulling on the cable.

As a result, the catch 65 is moved inwardly, freeing the stud 32 and subjecting the control member 20 to the action of the resilient spiral spring 42 (FIG. 5). As the support member 12 and casing 18 are held fixed in the socket 16, the control member 20 is turned about its axis of symmetry in the clockwise direction (viewed from the socket) and the grooves 44 force the studs 46 and hence the thrust members 30 to move towards the support member 12. As the shoulders 31 of the thrust members 30 abut the outer peripheral surface 76 of the socket 16, they remain fixed and therefore, by reaction, the casing 18, the support member 12 and the contact pins 14 move away from the bottom of the socket 16 as indicated by the arrow F in FIG. 3.

At the end of their ejection stroke, the thrust members 30 have returned to the position shown in FIG. 1 and the contact pins 14 of the plug 10 have been fully disconnected from the clips of the electric socket 16 since the length of travel of the thrust members 30 corresponds to the length of the contact pins 14. The plug will, therefore, be expelled from the socket. It will be observed that the pins 14 cannot be partially retracted, which can cause sparking or heavy current through limited contact area which can cause burning or damage to the contacts.

Consequently, a pull of a given minimum force, applied to the cable only, causes the trigger system 50 to move and compress the spring 80 and release the control member 20 which rotates and automatically completely disconnects the plug 10 from a socket 16.

Since this minimum force depends on the characteristics of the spring 80, it is very easy for manufacturers to adapt the actuation threshold to various types of plugs and sockets, or to the uses of the appliances concerned (vacuum cleaners, floor polishers, etc.).

The second resilient means herein shown as the spring 80 can advantageously be made of rubber, if desired, so as to protect the plug from water splashes, or possibly to make it watertight, depending on the type of appliance to which it is connected.

Furthermore, the mechanical advantage (in the range 2:1 to 4:1, preferably averaging 3:1) afforded by the pitch of the helical cam grooves 44 has the result that the first resilient means herein shown as the spiral spring 42 can be a relatively light spring which is easily compressed by the user. Even with a light spring 42 the mechanical advantage of the cam grooves produces an axial ejection force by the thrust members 30 which is large enough to overcome the holding force exerted by the clips of the socket on the contact pins 14. In the example described, the compression value of the spring 42 is desirably about one third of the value set by standards for manual disconnection of a plug from a socket.

The profile of the preferably rounded rim of the hole in the casing 18 for entry of the cable 22 allows the disconnect mechanism to be actuated at angles of up to approximately 180° between the cable and the axis of symmetry of the plug.

To improve this feature, and in particular allow disconnect when the angle is 90° or even greater than 90°, it is preferred that a relatively flexible sleeve 84 (FIG. 2) made of rubber, or simply consisting of a spring, be used at the entrance to the casing 18, to give the cable 22 an appropriate radius of curvature. In experiments, by fitting a sleeve approximately 50 mm long, 5 mm thick and/or with a tapered profile, reliable actuation of the disconnect mechanism has been obtained at angles close to 180° (with the cable parallel with the axis of symmetry of the plug after the radius of curvature, and with the force applied in the opposite direction) with no perceptible increase in the pulling force.

As the diameter of the casing 18 is imposed by standards, it will be seen that the proposed arrangement makes it possible to provide a plug having a length reasonably close to that of standard plugs available on the market since the increase in diameter due to the control member 20 is only slight, and occurs at the rear end of the plug. This means that it can easily be used in "multiplug" outlets.

In the example described, the support member 12 is a standard removable support for contact pins available on the market.

As can be seen, the number of parts required for the disconnect mechanism of the invention is very few, and this greatly facilitates its assembly.

For electric plugs which are fully moulded, i.e., non-removable, the support member 12 and casing 18 can advantageously be made in one piece.

Moreover, the slots allowing assembly of the various parts and in particular of the control member 20 are located in positions such that they cannot be reached in course of movement, thus making it impossible for the user to dismantle the assembly easily.

Since the actuation of the device is brought about by a minimum pull exerted on the electric cable, that cable, and hence its conductors, are protected against any excessive elongation, deformation or tension which could cause them to be damaged.

Because the shoulders 31 of the thrust members 30 abut the outer peripheral surface 76 of the socket 16, that socket, and in particular its fixing, is not subjected to any particular load upon disconnect of a plug.

Rather than link the actuation of the trigger system 50 to the power cable, an alternative arrangement is to provide a pushbutton (not shown) located on the casing 18 of the plug, for example. In this case, the pushbutton acts directly on the catch 65, the trigger system 50 remaining fixed; the actuation threshold is then set by resilient means applied to the catch 65 itself.

A separate member (for example, a cable, lever, etc.) may be utilized to effect the movement of the trigger system 50 or catch 65, such separate member passing through the sleeve containing the conductors, but leaving the conductors completely unaffected during the disconnect operation.

Embodiments of FIGS. 10–16

Shown in FIGS. 10–16 are two embodiments of an electrical fitting 110, 200 with disconnect mechanism according to the invention operated responsive to a pull on the cord or cable connected to the fittings which embodiments meet the various standards at present in force in the U.S.

As shown in FIGS. 10–15, the disconnect mechanism is applied to an electrical plug 110. Like any standard electrical plug, the plug 110 comprises a support member 112 for contact pins 114 adapted to be inserted in powered clips of a socket 116 (FIG. 10), and a casing 118. In addition, in accordance with the invention, a circular control member 120 is rotatively mounted to the casing 118.

The support member 112, which is removable from the casing 118, carries the contact pins or prongs 114 (ground pin 115 may also be included) to which the wire conductors of a standard electric cable 122 are connected via screw-threaded connectors 123 for securing the wire conductors of the cable at the back side of the support member 112. The support member is fixed to the casing 118 with a screw 124 (FIGS. 13, 14) and the screw threaded connectors 123 are received in recesses 125 (FIG. 11) in the casing 118.

In the preferred embodiment illustrated, the casing 118 is substantially cylindrical in shape and at its other rearward end, the casing 118 allows the passage of the cable 122.

Figure 12:
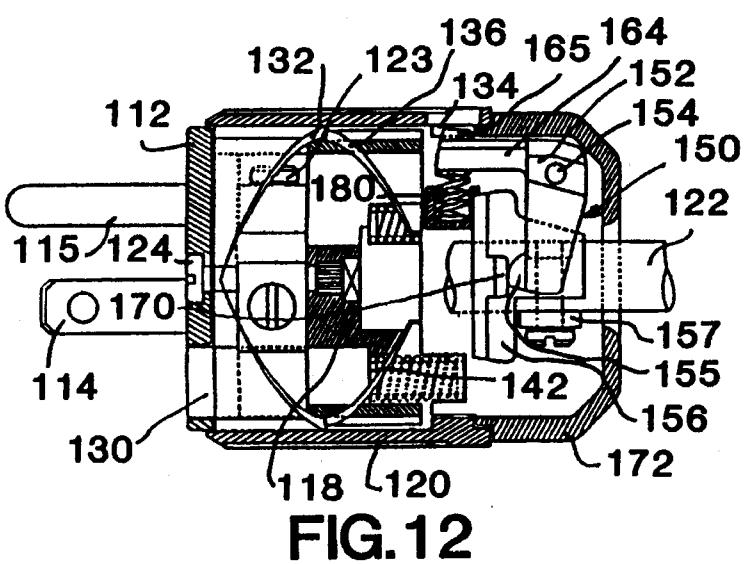
FIG. 12 is a sectional view of a terminal fitting as shown in FIG. 10 with the disconnect mechanism cocked but without the socket or outlet.
Figure 11:
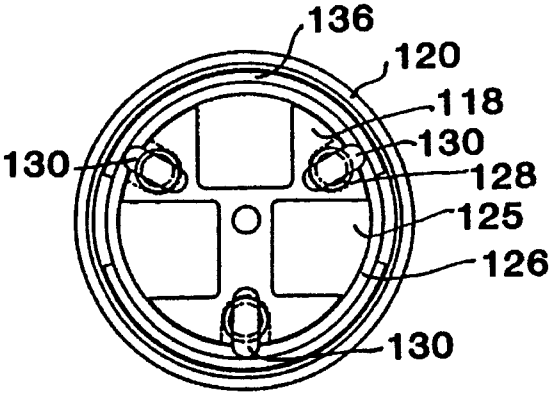
FIG. 11 is a front view of a terminal fitting with disconnect mechanism as shown in FIG. 10, but without the socket or outlet, and after removal of the support member.
Figure 15:
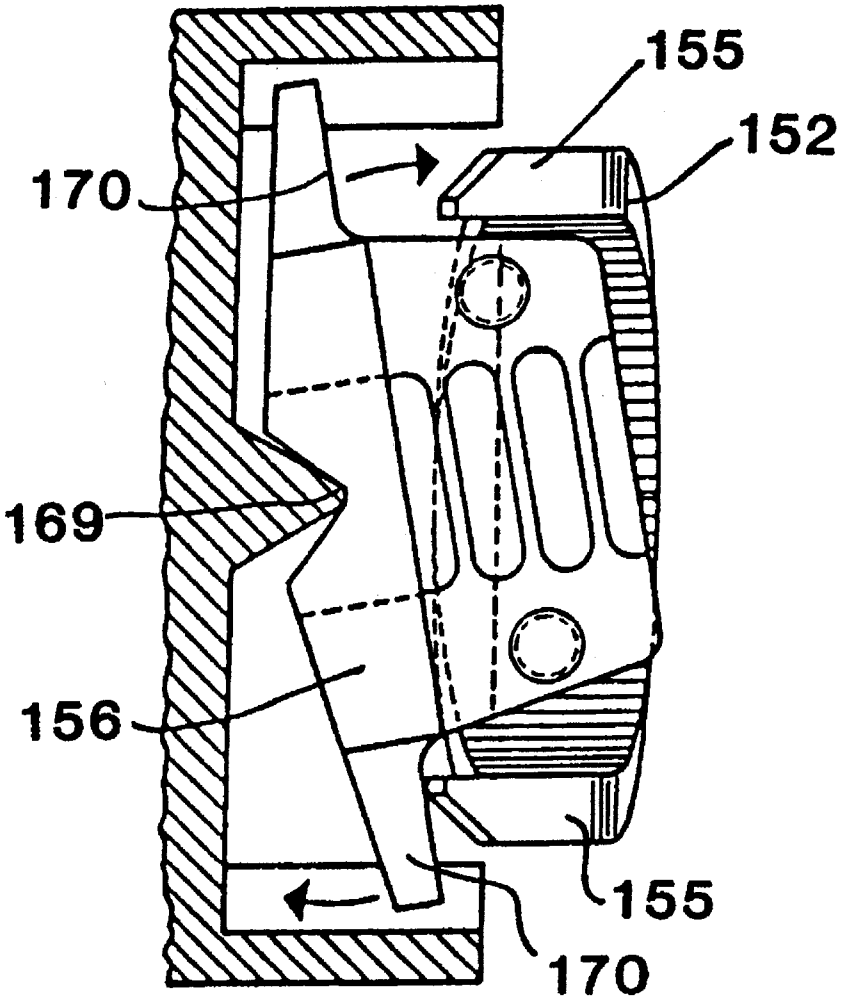
FIG. 15 is similar to FIG. 14, with elements of the disconnect mechanism being actuated.
Figure 14:
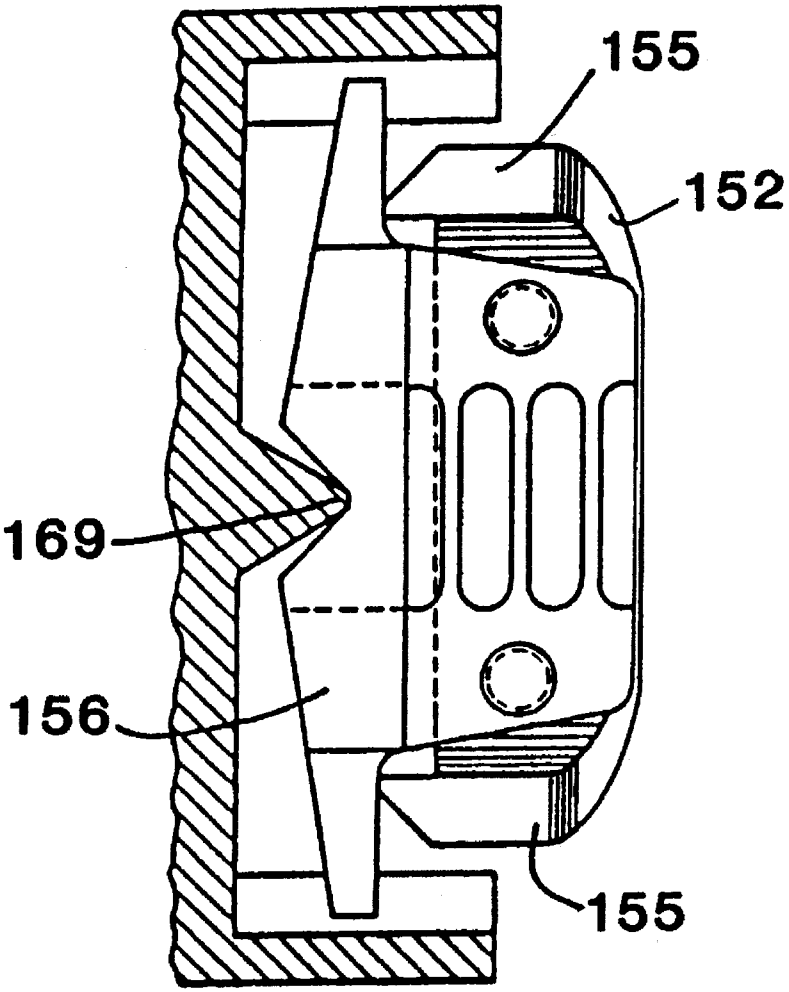
FIG. 14 is a partial sectional view of elements shown in FIG. 12, as viewed from the bottom.

According to the preferred embodiment for the U.S. plug, recesses 128 are provided near the peripheral surface of the casing 118 and axially movable thrust members 130 are supported in the recesses 128 preferably at about 120° (FIG. 11). The thrust members 130 are integral with an annular member 126 sliding at the periphery of the casing 118. The length of axial travel of the thrust members 130 in the recesses 128 essentially corresponds to about ⅔ of the length of the contact pins 114. The forward ends of the thrust members 130 are aligned with the front of the support member 112 when in a retracted cocked position, as shown in FIG. 12.

The control member 120 is mounted coaxially on the casing 118 and is guided in rotation by the outer periphery of the casing 118. The control member 120 includes two studs 134 which are diametrically opposed so that one of them is engaged by a catch to hold the control member 120 in the cocked position (FIG. 12), whether said control member is rotated clockwise or counterclockwise.

The recesses 128 within the casing 118 house resilient means, for example compression springs 142, between the end of the casing 118 and the thrust members 130 so that the thrust members 130 are pushed to project outward (forward) by the action of these resilient means, when a trigger system is released, while the casing 118 is fixed.

In carrying out the invention, cam means are provided for moving the thrust members 130 axially rearward and forward responsive to rotation of the control member 120; for this purpose the inner surface of the control member 120 has a cam surface 132 (FIGS. 10, 12, 13) cooperating with a cam surface 136 provided on the front end of the annular member 126 supporting the thrust members 130 which cause the latter to move axially in the recess 128 upon rotation of the control member 120.

It will now be seen that rotation of the control member 120 one way or the other about its axis of symmetry causes the thrust members 130 to move forward to project from the casing 118 or rearward in the opposite direction away from the support member 112 to a retracted position in the recesses 128 in the casing 118.

Further in accordance with the invention, a trigger system 150 (shown in FIGS. 12–15) is provided to hold the thrust members 130 in the rearward, retracted, cocked position as shown in FIG. 12, the trigger system 150 in this case being connected to the cable 122 and acting on the control member 120.

Figure 13:
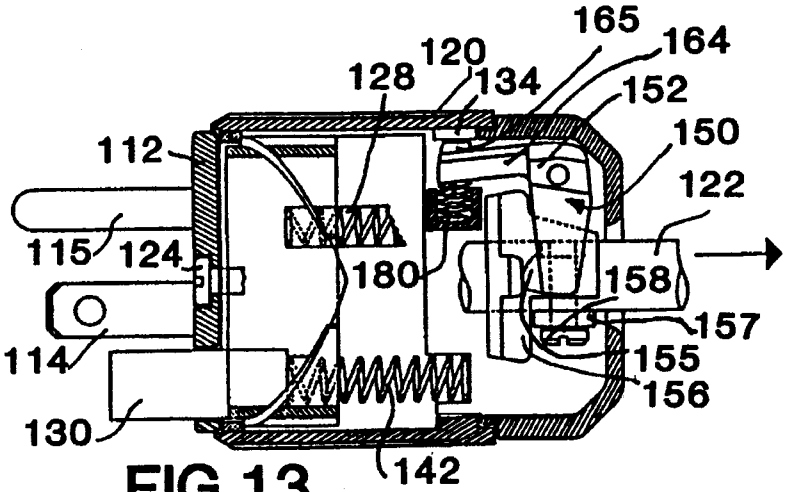
FIG. 13 is similar to FIG. 12, but with the disconnect mechanism being released by pulling on the cable.

This trigger system 150 in this instance includes a fork 152 which swivels in a vertical plane about the axis 154 of a pin which is fixed to the casing 118. At one end, the fork 152 has two pads 155 for cooperating with a member 156 which is mounted to pivot in a horizontal plane laterally within the casing 118. As shown in FIGS. 12 and 13, the cable 122 is clamped to this member 156 by a pad 157 tightened by screws 158. The fork 152, which is preferably molded metal or resin, has a lug 164 which carries a catch 165 (see FIGS. 12, 13). The member 156, also preferably molded resin, pivots laterally on two sharp edges 169 located at the rear end of the casing 118 (see FIGS. 14, 15 which are bottom views wherein the cable is not represented) and also vertically about each edge 169. Due to this "universal" support, the cable which is clamped to the member 156 may extend from the casing 118 at angles of 90° or greater in any direction and still swivel the fork 152 and actuate the catch 165 of the trigger system. Two lateral arms 170 cooperate with the pads 155 of the fork 152. All the major elements of the plug 110 except the contact pins 114 are preferably of molded resin for strength and insulating properties, but the manufacturer can choose the materials desired for these elements. A cover 172 is provided at the rear end of the casing 118 and allows passage of the cable 122.

In the released position, the disconnect mechanism of the invention is located in the configuration depicted in FIG. 13. Preferably, the thrust members 130 which project from the casing 118 prevent insertion of the plug 110 into the recess of a standard socket 116, which is shown diagrammatically and partially in FIG. 10 since they abut against the outer surface 176 or face of the socket 116 before the contact pins 114 can engage the powered clips in the body of the socket.

Rotation of the control member 120 with respect to the casing 118 in the counterclockwise or clockwise direction and against the resilient means 142 causes the cam 132 to rotate which causes the thrust members 130 to retract rearward towards the back of the plug 110 and into the recesses 128; the cam 132 may have a changing slope so that in the ejection stroke a large initial thrust force will be exerted by the members 130 to start the withdrawal movement of the pins 114, which then drops off to complete the withdrawal movement; rotation of the stud 134 inside the control member 120 (the stud 134 has a sloping surface) deflects the lug 164 inwardly and thus allows the stud 134 to pass beneath and to the other side of the catch 165 (see FIG. 13) where it is held by the catch 165 (see FIG. 12).

The disconnect mechanism, according to this invention, is then in the position shown in FIG. 12, that is to say in the cocked position, with the catch 165 retaining the control member 120 (via the stud 134) against the action of the resilient means 142.

Figure 10:
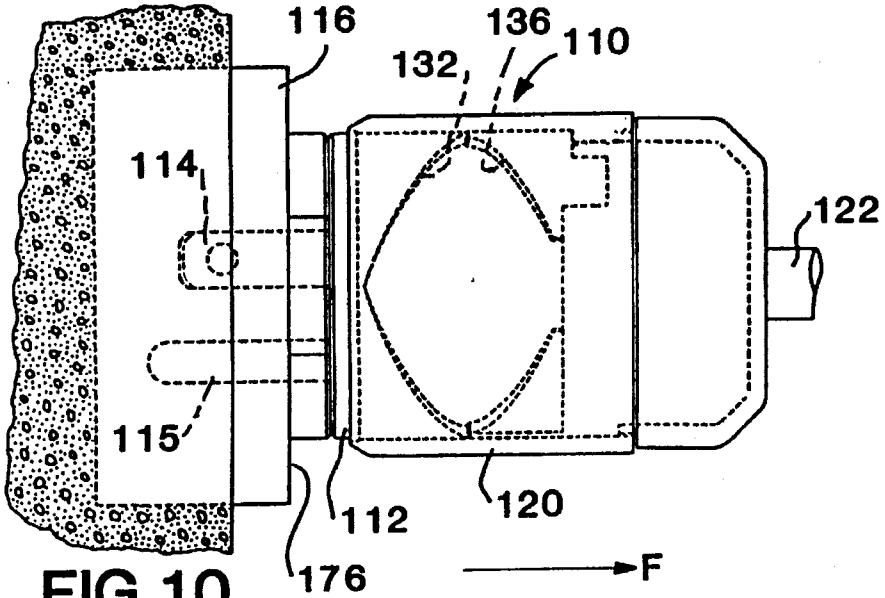
FIG. 10 is a side view of a terminal fitting with disconnect mechanism according to this invention, which has been modified compared with FIGS. 1–9 to meet U.S. standards, and is herein shown as a plug with disconnect mechanism inserted in a socket or outlet.

As the thrust members 130 have been retracted, the plug 110 can now be fully inserted into a socket 116 (see FIG. 10).

The electrical plug 110 then stays in this inserted position in the socket 116 until the trigger system 150 is actuated to move the catch 165 downward far enough to clear the stud 134 and thereby release the control member 120 for rotation by the resilient means 142, which causes the thrust members 130 to move forward in their ejection stroke. Forward movement of the thrust members 130 relative to the casing 118 causes the plug 110 to be ejected from the socket 116 by reaction.

According to this embodiment of the invention, the trigger system 150 is released by pulling on the cord or cable 122. The threshold value of force for such a pull is determined, in particular, by the characteristics of a second resilient means, for example, a compression spring 180, positioned between the casing 118 and the trigger system 150 and keeping the latter in the cocked position shown in FIG. 12.

When a pull which exceeds the threshold value is exerted on the cord or cable 122, the element 156 rotates around or about one of the edges 169 (FIG. 15) and thus at least one of the pads 155 is retracted. As a result, the fork 152 is pivoted and the spring 180 is compressed. When its threshold value is exceeded then the lug 164 is pivoted downwards (FIG. 13).

As a result, the catch 165 is moved inwardly, freeing the stud 134 and subjecting the control member 120 to the action of the resilient springs 142 (FIG. 13). As the support member 112 and casing 118 are held fixed in the socket 116, the control member 120 is turned about its axis of symmetry either in the clockwise or counterclockwise direction. In the cocked position, the front faces of the thrust members 130 are flush with the front face of the support member 12. When the trigger mechanism is released, the cam surfaces 136 force the thrust members 130 to move forward. As the thrust members 130 move forward and project from the casing 118, they come into abutment with the outer face 176 of the socket 116 causing the control member 120 to be turned about its axis of symmetry either in the clockwise or counterclockwise direction. As the thrust members 130 abut the face 176 of the socket 116, they remain fixed and therefore, by reaction, the casing 118, the support member 112 and the contact pins 114 move away from the bottom of the socket 116 as indicated by the arrow F in FIG. 10.

At the end of their ejection stroke, the thrust members 130 have returned to the fully projecting position shown in FIG. 13 and the contact pins 114 of the plug 110 have been fully disconnected from the clips of the electric socket 116. The plug will, therefore, be expelled from the socket. It will be observed that the pins 114 cannot be partially retracted, which can cause sparking or heavy current through limited contact area which can cause burning or damage to the contacts.

Consequently, a pull of a given minimum force, applied to the cable only, causes the trigger system 150 to move and compress the spring 180 and release the control member 120 which rotates and automatically completely disconnects the plug 110 from a socket 116.

Since this minimum force depends on the characteristics of the spring 180, it is very easy for manufacturers to adapt the actuation threshold to various types of plugs and sockets, or the uses of the appliances concerned (vacuum cleaners, floor polishers, etc.).

Furthermore, the mechanical advantage (in the range 2:1 to 4:1, preferably averaging 3:1) afforded by the pitch of the cam surfaces 132, 136 has the result that the first resilient means herein shown as the compression springs 142 can be relatively light springs which are easily compressed by the user. Even with light springs 142 the mechanical advantage of the cam produces an axial ejection force by the thrust members 130 which is large enough to overcome holding force exerted by the clips of the socket on the contact pins 114. In the example described, the compression value of the spring 142 is desirably about one third of the value set by standards for manual disconnection of a plug from a socket.

Thanks to the edges 169 provided at about 180° and the pivoting of the element 156, the above described mechanism automatically disconnects mating fittings when the cord or cable extends from the casing 118 at an angle of 90° or even greater than 90°. In experiments, reliable actuation of the disconnect mechanism has been obtained at angles close to 180° (with the cord or cable parallel with the axis of symmetry of the plug after the radius of curvature, and with the force applied in the opposite direction) with no perceptible increase in the pulling force.

The diameter of the casing 118 is set so that the proposed arrangement makes it possible to provide a plug having a length reasonably close so that of standard plugs available on the market since the increase in diameter due to the control member 120 is only slight. This means that it can easily be used in "multiplug" outlets.

As can be seen, the number of parts required for the disconnect mechanism of the invention is very few, and this greatly facilitates its assembly.

Since the actuation of the device is brought about by a minimum pull exerted on the electrical cord or cable, that cord or cable, and hence its conductors, are protected against any excessive elongation, deformation or tension which could cause them to be damaged.

Because the thrust members 130 abut the face 176 of the socket 116, that socket, and in particular its fixing, is not subjected to any particular load upon disconnect of a plug.

Figure 16:
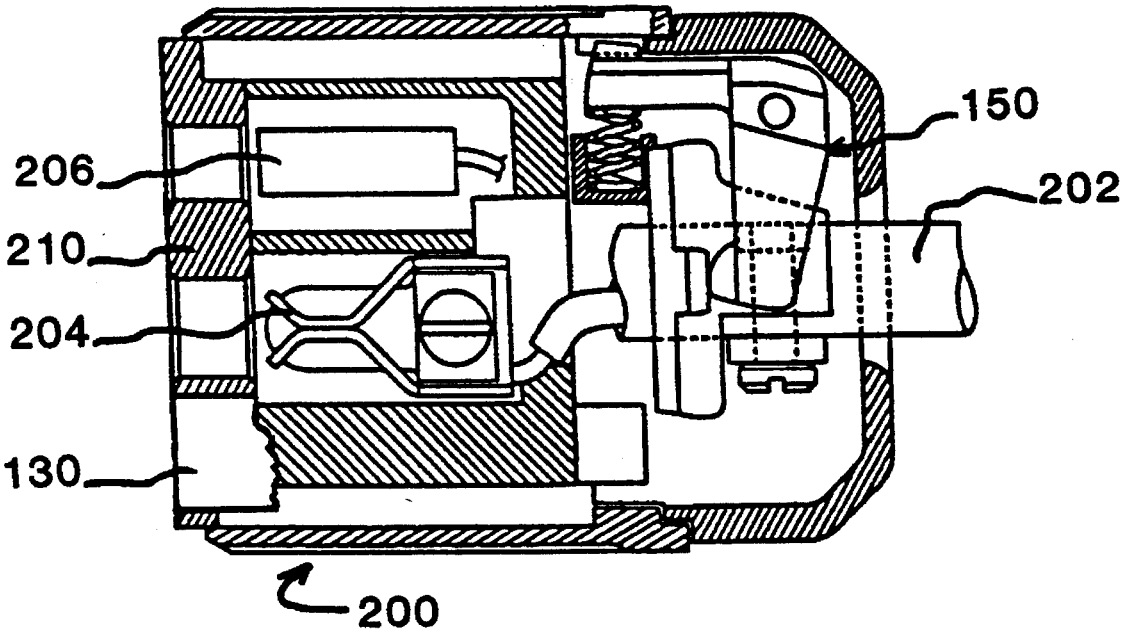
FIG. 16 is a fragmentary sectional view of a terminal fitting, herein shown as a socket with disconnect mechanism, and illustrates the invention applied to a socket of mating fittings.

FIG. 16 is a sectional view of a terminal fitting, herein shown as a socket 200 with disconnect mechanism which is operated responsive to a pull on the connected cord or cable 202, and illustrates the invention may be applied to either one of mating fittings, i.e., either a plug 110 as shown in FIGS. 10–15 or a socket 200 as shown in FIG. 16. The socket 200 includes receptacle clips 204 which receive prongs of a mating fitting (not shown in FIG. 16) to provide a conductive path through the fittings.

A socket 200 with disconnect mechanism of the invention has many applications, an exemplary one of which is to provide electrical power to recharge storage batteries of a vehicle, for example, an ambulance which has storage batteries to operate medical equipment mounted in the ambulance. Recharging the batteries takes place when the ambulance is garaged, and electrical power is supplied to the vehicle through the cable 202 connected to the vehicle and a terminal fitting adapted to be mated to a terminal fitting connected to a power source through a power cable. A problem arises when, in response to an emergency call, the ambulance is driven off without first disconnecting the mating fittings. In the past where there has been no automatic mechanism, the power cable or vehicle cable may be torn apart, or the mating fittings forcibly separated by the pull on the vehicle cable as the ambulance starts up to be driven off. With the automatic disconnect mechanism of this invention incorporated in the fitting at the end of the vehicle cable, i.e., the cable connected to the vehicle, the pull on the vehicle cable operates to disconnect the mating fittings. However, if the terminal fitting on the vehicle cable is a plug as shown in FIGS. 1–15, after the mating fittings have been disconnected, the fitting on the vehicle cable is left dangling from the vehicle and when the fitting is a plug the prongs of the plug are exposed which can be dangerous since they are connected through the vehicle cable to the storage batteries and can create a short-circuit if they come into direct contact with the ground, a pool of water or the like.

If the terminal fitting at the end of the vehicle cable is a socket 200 as shown in FIG. 16, after the mating fittings have been disconnected responsive to the pull on the cable, there are no exposed prongs on the fitting at the end of the dangling cable, which reduces the risk of short circuit or electrical malfunctions.

Turning again to FIG. 16, the socket 200 includes the same disconnect mechanism as found in the plug 110 of FIGS. 10–15 but the prongs 114, 115 of the plug 110 are replaced by receptacle clips 204, 206 contained within the fitting casing 210 and thus shielded from exposure including ground and power conductor clips. The same arrangement of thrust members 130 and trigger system 150 is 10 included in the socket 200 connected to the cable, the thrust members 130 being operated responsive to a pull on the vehicle cable 202 to project from the casing 210 into engagement with a face of the mating fitting and thereby to separate the fittings, preventing massive disruption of the mating fittings or connected cables.

While reference has been made to an emergency vehicle, it should be understood that the use of the embodiment of terminal fitting 200 is not limited to use on such a vehicle, but rather it can be used in any application where it is desired to have a disconnect mechanism incorporated in a socket and operated responsive to a pull on the cable on which the socket is a terminal fitting.

I claim:

1. An electrical fitting to be connected to an end of a cable, including an automatic disconnect mechanism which separates the electrical fitting from a mating electrical fitting responsive to a pull on the cable, the electrical fitting comprising:

a casing which receives the end of the cable;

electrical contact elements in the casing adapted to be connected to conductors carried by the cable;

at least one thrust member mounted in the casing for axial movement in ejection and retraction strokes between retracted and projecting positions;

a resilient member in the casing;

a control member mounted in the casing for movement against force produced by the resilient member to a cocked position;

a trigger system which holds the control member in the cocked position and is actuable to release the control member for movement therefrom;

a cam which causes the thrust member to move axially responsive to movement of the control member in the ejection and retraction strokes, the thrust member also being movable to the retracted position upon movement of the control member to the cocked position;

a connection between the cable and the trigger system which causes a pull on the cable of greater than a predetermined force to release the control member from the cocked position, the thrust member being moved axially in the ejection stroke to the projecting position by action of the resilient member after release of the control member to engage a fixed element associated with a mating fitting and cause the casing and the electrical contact elements therein to be moved by reaction and separated from contact elements of the mating fitting.

2. A fitting according to claim 1 including a clamp clamped to the end of the cable, the clamp being carried by a member which actuates the trigger system responsive to a pull on the cable.

3. A fitting according to claim 1 wherein the electrical contact elements in the casing comprise elements of a plug assembly including a support member carrying external axially projecting pins which are insertable in contact clips of a mating socket and are retracted therefrom upon relative axial movement of the support member and the socket produced by the thrust member.

4. A fitting according to claim 1 wherein the electrical contact elements in the casing comprise elements of a socket assembly including contact clips mounted internally within the casing which receive contact pins of a mating plug which are retracted therefrom upon relative axial movement of the socket assembly and the plug produced by the thrust member.

5. A fitting according to claim 1 wherein the trigger system includes a fork supporting a catch which is mounted to swivel in a vertical plane about a fixed horizontal axis in the casing, and a member clamped to the cable which is mounted to pivot in a horizontal plane laterally within the casing and engage the fork to swivel the fork and actuate the catch responsive to a pull on the cable, allowing the cable to extend from the casing at angles of about 90 degrees in any direction and still swivel the fork and actuate the catch of the trigger system.

6. A fitting according to claim 1 wherein a catch of the trigger system is movably mounted on the casing and is engaged by a detent on the control member to hold it in the cocked position, and wherein the catch is moved responsive to a pull on the cable to release the control member.

7. A fitting according to claim 6 wherein the control member comprises a rotatably mounted cylindrical member having the detent on an inner surface which is engaged by the movable catch, the catch is moved radially to clear and release the detent responsive to a pull on the cable of a force greater than the threshold force, and the control member is rotated responsive to force produced by the resilient member and moves the thrust member after the detent is released.

8. A fitting according to claim 6 wherein the catch of the trigger system is pivotably mounted in the casing, the detent is fixed to the control member which is rotatable in the casing, and a second resilient member is included in the casing exerting force on the catch which urges it to a catch position in which the catch is engaged by the detent and holds the control member in the cocked position, and wherein pivotal movement of the catch is opposed by the second resilient member providing the predetermined threshold force which must be overcome by a pull on the cable to actuate the catch to release the detent and allow the control member to rotate from the cocked position.

9. A fitting according to claim 1 wherein the cam which moves the thrust member provides a mechanical advantage which results in a greater force exerted by the thrust member in the ejection stroke than force exerted by the resilient member after release of the control member by the trigger system.

10. A fitting according to claim 9 wherein the cam includes helical cam surfaces provided by slots in the control member and a follower comprising a stud on the thrust member.

11. A fitting according to claim 1 wherein a second resilient member within the casing provides the predetermined threshold force which must be overcome by a pull on the cable to actuate the trigger system.

12. A fitting according to claim 11 wherein the second resilient member is mounted between a member clamped to the cable and the casing.

13. A fitting according to claim 11 wherein the second resilient member is mounted between the movable catch and the casing.

14. An electrical fitting to be connected to an end of a cable, including an automatic disconnect mechanism which separates the electrical fitting from a mating electrical fitting responsive to a pull on the cable, the electrical fitting comprising:

a casing which receives an end of the cable;

electrical contact elements in the casing adapted to be connected to conductors carried by the cable;

at least one thrust member mounted in the casing adjacent the contact elements for axial movement in ejection and retraction strokes between retracted and projecting positions;

a first resilient member in the casing;

a control member mounted in the casing for movement against force produced by the first resilient member to a cocked position;

a trigger system including a movable catch which has a catch position in which it holds the control member in the cocked position and is actuable to release the control member for movement therefrom;

a cam which moves the thrust member axially responsive to movement of the control member in the ejection and retraction strokes and retracts the thrust member to the retracted position upon movement of the control member to the cocked position;

a connection between the cable and the trigger system which causes the disconnect mechanism to be operated to separate mating fittings by transmitting a pull on the cable to actuate the catch and release the control member from the cocked position, the thrust member being moved axially in the ejection stroke to the projecting position by action of the first resilient member after release of the control member by actuation of the catch; and a second resilient member mounted within the casing and exerting a force which acts to hold the catch in the catch position, and which is overcome by a pull on the cable of greater than a predetermined threshold force to actuate the catch and thereby release the control member from the cocked position so that the first resilient member acts to move the thrust member in the ejection stroke to engage a fixed element associated with a mating fitting and cause the casing and the electrical contact elements therein to be moved by reaction and separated from contact elements of the mating fitting.

15. An electrical fitting to be connected to an end of a cable, including an automatic disconnect mechanism which separates the electrical fitting from a mating electrical fitting responsive to a pull on the cable, the electrical fitting comprising:

a casing having an opening which receives the end of the cable;

a support member mounted in the casing;

a plug assembly carried by the support member including projecting pins and fastener elements in the casing adapted to connect the plug assembly to conductors carried by the cable;

at least one thrust member mounted in the casing for axial movement in ejection and retraction strokes between retracted and projecting positions;

a resilient member in the casing;

a control member mounted in the casing for movement against force produced by the resilient member to a cocked position;

a trigger system including a movable catch which has a catch position in which it holds the control member in the cocked position and is actuable to release the control member for movement therefrom;

a cam which moves the thrust member axially responsive to movement of the control member in the ejection and retraction strokes and retracts the thrust member to the retracted position upon movement of the control member to the cocked position;

a connection between the cable and the trigger system which causes the disconnect mechanism to be operated to separate mating fittings by transmitting a pull on the cable of greater than a predetermined force to actuate the catch and release the control member from the cocked position, the thrust member being moved axially in the ejection stroke to the projecting position by action of the resilient member after release of the control member by actuation of the catch to engage a fixed element associated with a mating fitting and cause the casing and plug assembly to be moved by reaction and separated from contact elements of the mating fitting.

16. An electrical fitting to be connected to an end of a cable, including an automatic disconnect mechanism which separates the electrical fitting from a mating electrical fitting responsive to a pull on the cable, the electrical fitting comprising:

a casing having an opening which receives the end of the cable;

a socket assembly including electrical contact elements in the casing adapted to be connected to conductors carried by the cable;

at least one thrust member mounted in the casing adjacent the contact elements for axial movement in ejection and retraction strokes between retracted and projecting positions;

a resilient member in the casing;

a control member mounted in the casing for movement against force produced by the resilient member to a cocked position;

a trigger system including a movable catch which has a catch position in which it holds the control member in the cocked position and is actuable to release the control member for movement therefrom;

a cam which moves the thrust member axially responsive to movement of the control member in the ejection and retraction strokes and retracts the thrust member to the retracted position upon movement of the control member to the cocked position;

a connection between the cable and the trigger system which causes the disconnect mechanism to be operated to separate mating fittings by transmitting a pull on the cable of greater than a predetermined force to actuate the catch and release the control member from the cocked position, the thrust member being moved axially in the ejection stroke to the projecting position by action of the resilient member after release of the control member by actuation of the catch to engage a fixed element associated with a mating fitting and cause the casing and the electrical contact elements therein to be moved by reaction and separated from contact elements of the mating fitting.

17. An electrical fitting to be connected to an end of a cable, including an automatic disconnect mechanism which separates the electrical fitting from a mating electrical fitting responsive to a pull on the cable, the electrical fitting comprising at least one thrust member mounted for axial movement in ejection and retraction strokes between retracted and projecting positions and a trigger system which causes a pull on the cable of greater than a predetermined force to release the thrust members from the retracted position, the thrust members being moved axially in the ejection stroke to the projecting position by a resilient member after release to engage a fixed element associated with a mating fitting and cause the casing and the electrical contact elements therein to be moved by reaction and separated from contact elements of the mating fitting.

* * * * *